US008139991B2

(12) United States Patent
Suzuki et al.

(10) Patent No.: US 8,139,991 B2
(45) Date of Patent: Mar. 20, 2012

(54) IMAGE FORMING APPARATUS CONTAINING COLOR SHADING CORRECTION AND BIAS CORRECTION OF INTERMEDIATE TRANSFER BELT

(75) Inventors: Chikatsu Suzuki, Hachioji (JP); Kenji Taki, Fuchu (JP); Fusako Ozawa, Hachioji (JP); Yusuke Yamamoto, Hachioji (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 703 days.

(21) Appl. No.: 12/323,497

(22) Filed: Nov. 26, 2008

(65) Prior Publication Data

US 2009/0148198 A1 Jun. 11, 2009

(30) Foreign Application Priority Data

Dec. 5, 2007 (JP) ..... 2007-315070

(51) Int. Cl.
*G03G 15/01* (2006.01)

(52) U.S. Cl. ..... 399/301; 399/302

(58) Field of Classification Search ..... 399/301, 399/302

See application file for complete search history.

(56) References Cited

U.S. PATENT DOCUMENTS 7,983,606 B2 * 7/2011 Cho ..... 399/301

FOREIGN PATENT DOCUMENTS

| | | |
|---|---|---|
| JP | 1-142679 A | 6/1989 |
| JP | 04-131874 | 5/1992 |
| JP | 9-048533 A | 2/1997 |
| JP | 2000-233843 | 8/2000 |
| JP | 2006-215237 | 8/2006 |

OTHER PUBLICATIONS

Office Action issued in Corresponding Japanese Application No. 2007-315070 dated Oct. 20, 2009, and an English Translation thereof.

* cited by examiner

*Primary Examiner* — William J Royer
(74) *Attorney, Agent, or Firm* — Buchanan Ingersoll & Rooney PC

(57) ABSTRACT

A bias correction is carried out before a color registration correction is carried out so as to stabilize the running state of an intermediate transfer belt, thereafter the bias correction ceases and the color registration correction is carried out.

9 Claims, 10 Drawing Sheets

IMAGE FORMING APPARATUS CONTAINING COLOR SHADING CORRECTION AND BIAS CORRECTION OF INTERMEDIATE TRANSFER BELT

This application is based on Japanese Patent Application No. 2007-315070 filed on Dec. 5, 2007, in the Japanese Patent Office, the entire content of which is hereby incorporated by reference.

TECHNICAL FIELD

The present invention relates to an image forming apparatus to form a color image, and in particular, to an image forming apparatus to conduct correction of color shading and bias correction of an intermediate transfer belt.

BACKGROUND OF THE INVENTION

In the image forming apparatus such as a tandem type color copying machine utilizing an electrophotographic process, image forming sections, configured with a photoconductive substance drum, a charging device, an optical scanning device and a developing device, are provided for respective colors i.e. yellow (Y), magenta (M), cyan (C) and black (K), and are disposed along an endless intermediate transfer belt so that a color image, formed by overlapping the images of respective colors Y, M, C and K on the rotating intermediate transfer belt, is transferred onto a transfer sheet from the intermediate transfer belt.

As above, in case the color image is formed by overlapping the images of respective colors, a clear image cannot be obtained due to color shift unless forming positions of images correspond to each other correctly between colors. Therefore it has been carried out that a test image, so called a registration mark, for correcting color shift is formed on the intermediate transfer belt, and an optical sensor reads the mark to derive a necessary correction amount so as to correct the forming positions of images formed by image forming devices for respective colors where necessary (for example Patent Document 1: Unexamined Japanese Patent Application Publication No. H1-142679).

Also, correction control is carried out so that the intermediate transfer belt runs stably, and to prevent the intermediate transfer belt from meandering and a bias (for example Patent Document 2: Unexamined Japanese Patent Application Publication No. H9-48533).

Patent Document 1: Unexamined Japanese Patent Application Publication No. H1-142679

Patent Document 2: Unexamined Japanese Patent Application Publication No. H9-48533

Bias correction control of the intermediate transfer belt is usually carried out on a steady basis so as to avoid color shift due to meandering and the bias of the intermediate transfer belt. However, if bias correction of the intermediate transfer belt is carried out during color registration correction, an amount of color shift measured based on the registration mark becomes a sum of a color shift amount caused by shift of the forming position of the image formed by the image forming section and a color shift amount of the intermediate transfer belt caused by bias correction. Therefore, if the color registration correction is carried out based on the color shift amount measured, the correction amount can be incorrect.

On the other hand, if the bias correction control of the intermediate transfer belt is simply ceased during the color registration correction, the color shift amount caused by meandering or the bias of the intermediate transfer belt during the color registration correction is included in the color shift amount measured. Thus if the color registration correction is carried out based on the measurement value, the correction amount becomes also incorrect.

SUMMARY OF THE INVENTION

To carry out the color registration correction without the color shift amount caused by the intermediate transfer belt being included, the present invention is provided with the following structures.

An image forming apparatus to form a color image, having;

a plurality of image forming sections to form images of respective colors;

an intermediate transfer belt on which the images of respective colors formed through the plurality of the image forming sections are transferred and overlapped so as to form a color image; and a control section to conduct color registration correction for correcting image forming positions of the images of respective colors formed by the plurality of image forming sections on the intermediate transfer belt and to conduct bias correction of the intermediate transfer belt for correcting a bias of the intermediate transfer belt;

wherein the color registration correction is carried out after a running state of the intermediate transfer belt is stabilized through the bias correction of the intermediate transfer belt.

In the above structure, the control section stabilizes a bias state of the intermediate transfer belt before the color registration correction. By stabilizing the intermediate transfer belt before color registration, the bias correction during the color registration correction becomes practically unnecessary. Therefore, even if the bias correction control is executed during the color registration correction, an actual bias correction amount becomes practically zero, thus color registration correction can be carried out without being affected by the bias correction. Also, even if the bias correction control is ceased during color registration correction, since the intermediate transfer belt is stabilized before execution of the color registration correction, color registration correction can be carried out without being affected by shift of the intermediate transfer belt.

DETAILED DESCRIPTION OF THE PREFERRED EMBODIMENT

An embodiment of the present invention will be described as follow based on the figures.

Figure 1:
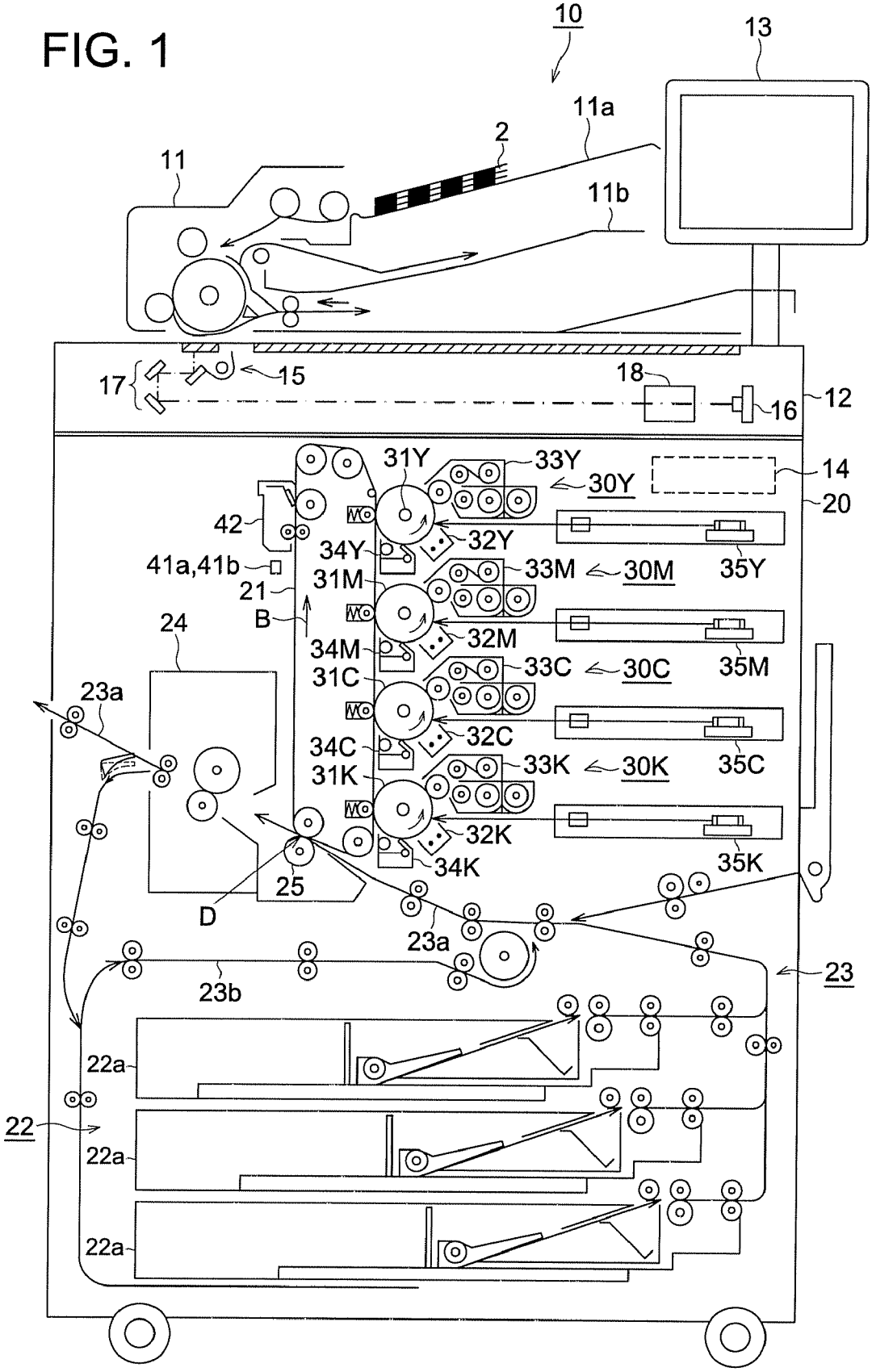
FIG. 1 is an explanatory drawing showing a cross-section of the image forming apparatus related to an embodiment of the present invention.
Figure 2:
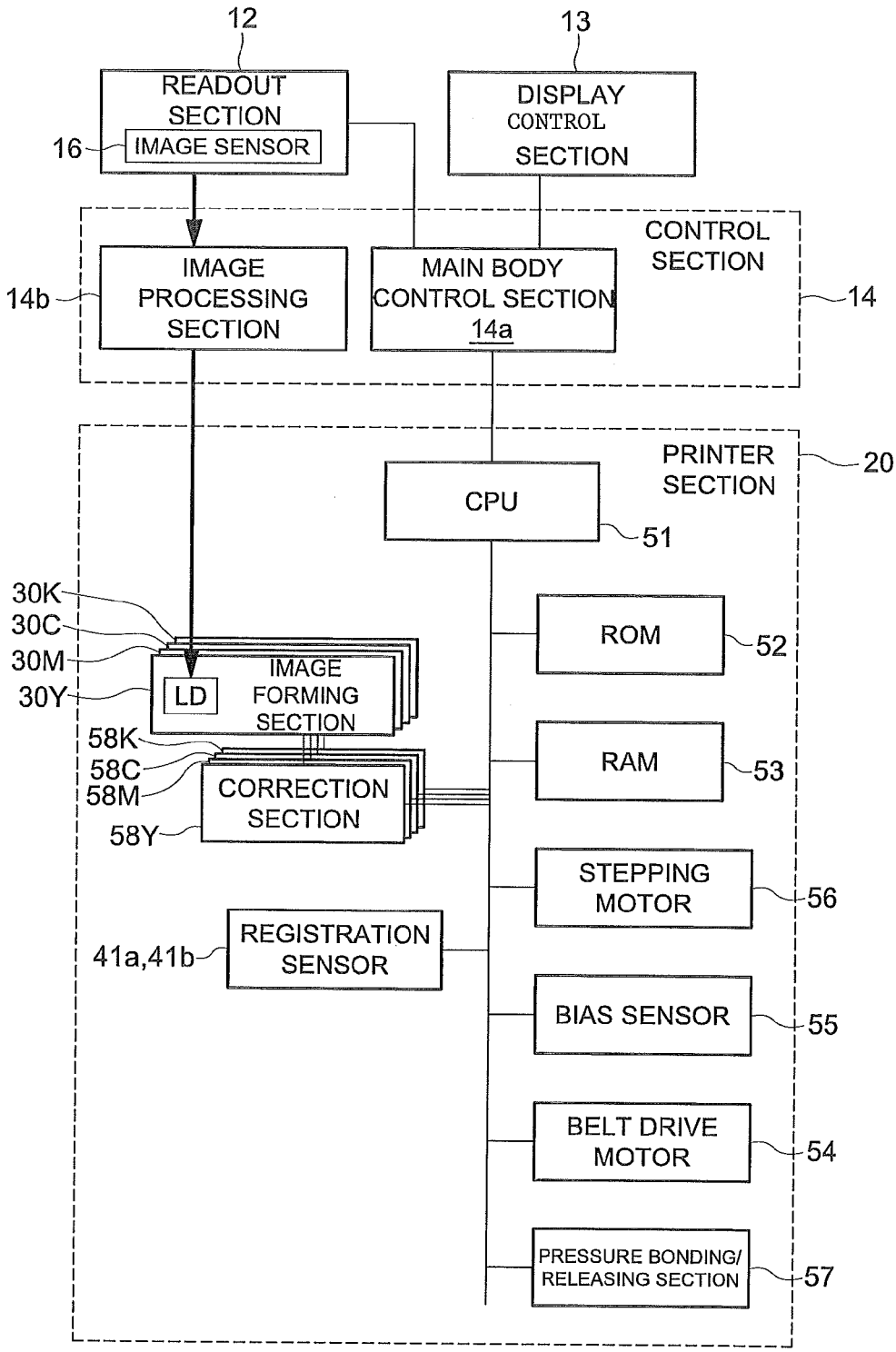
FIG. 2 is a block diagram showing a schematic diagram of an electrical configuration of the image forming apparatus related to an embodiment of the present invention.

FIG. 1 shows a cross-sectional view showing a structure of an image forming apparatus 10 and FIG. 2 shows a schematic diagram of an electric configuration of the image forming apparatus 10. The image forming apparatus 10 is an apparatus called a color digital multifunction peripheral, configured with a readout section 12 having an automatic document feeding device 11, a display control section 13, a control section 14 and a printer section 20.

The automatic document feeding device 11 (see FIG. 1), serves functions in feeding a document 2 stacked on a document stacker tray 11*a* to a reading position of the readout section 12 one by one, and ejecting the document having been read to a sheet ejection tray 11*b*.

The readout section 12 is provided with a function to read the document in color. The readout section 12 is provided with a scanning exposure section 15 configured with a light source and a mirror, a line color image sensor 16 to receive light reflected by the document 2 and to output electric signals in accordance with light intensity of the light thereof respectively for colors, various mirrors 17 and condensing lens 18 to lead the light reflected by the document 2 to the line color image sensor 16.

The printer section 20 is a tandem type image forming apparatus provided with an intermediate transfer belt 21 in a shape of an endless belt, a plurality of image forming sections 30Y, 30M, 30C and 30K to form images having single color respectively on the intermediate transfer belt 21, a sheet feeding section 22 to feed a transfer sheet, conveyance section 23 to convey the transfer sheet fed and a fixing device 24.

The image forming section 30Y forms a yellow color (Y) image on the intermediate transfer belt 21, the image forming section 30M forms a magenta color (M) image on the intermediate transfer belt 21, the image forming section 30C forms a cyan color (C) image on the intermediate transfer belt 21, and the image forming section 30K forms a black color (K) image on the intermediate transfer belt 21.

The image forming section 30Y is provided with a photoconductive substance 31Y representing an electro-static latent image carrier in a shape of a cylinder on whose surface an electrostatic latent image is formed, and a charging device 32Y, a developing device 33Y and a cleaning device 34Y disposed at a periphery thereof. Also the image forming section 30Y is provided with a laser unit 35Y configured with a laser diode, a polygon mirror, various kinds of lenses and mirrors.

Figure 3:
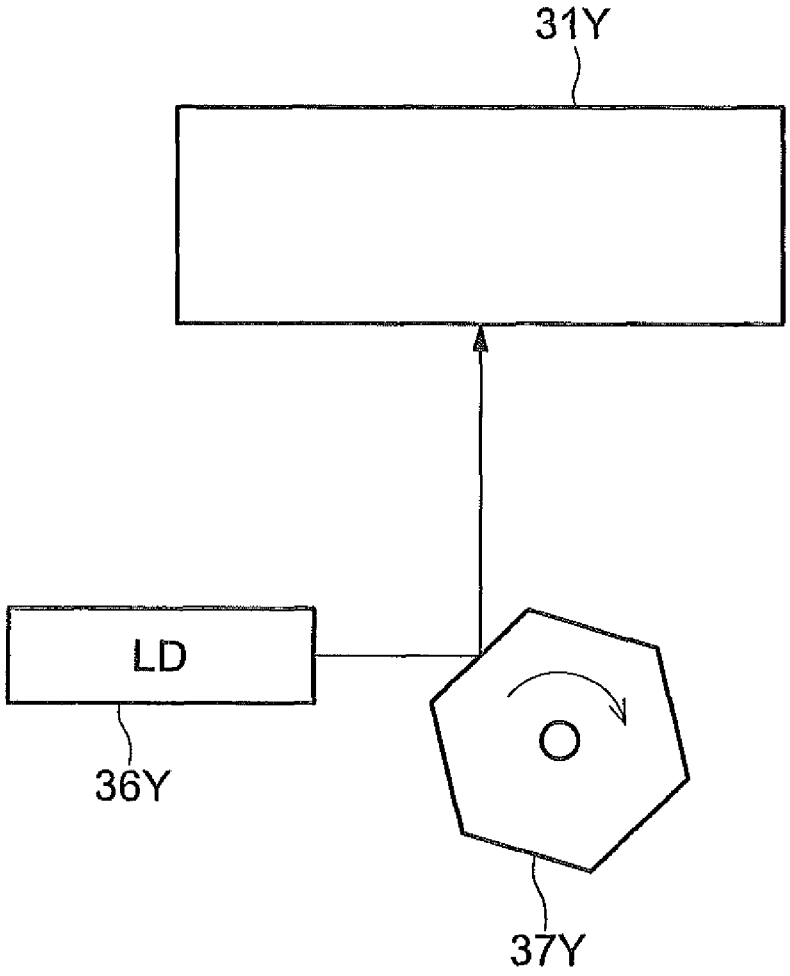
FIG. 3 is an explanatory drawing describing a manner where laser light reflected by a polygon mirror scans a photoconductive substance.

The photoconductive substance 31Y rotates in a given direction (a direction shown by an arrow, through an unillustrated drive section and the charging device 32Y charges the photoconductive substance 31Y evenly. The laser unit 35Y serves a function to repeatedly scan the surface of the photoconductive substance 31Y in the shape of the cylinder in an axis direction (main scanning direction) with the laser light by reflecting the laser light radiated from a laser diode (LD) 36Y with a rotating polygonal mirror 37Y as shown in FIG. 3.

The electrostatic latent image is formed on the photoconductive substance 31Y by scanning the uniformly charged surface of the photoconductive substance 31Y with the laser light which turns on and off in accordance with image data of yellow color. The developing device 33Y visualizes the electrostatic latent image on the photoconductive substance 31Y with toner of yellow color. The toner image formed on the surface of the photoconductive substance 31Y is transferred onto the intermediate transfer belt 21 at a position where the intermediate transfer belt 21 contacts. The cleaning device 34Y serves a function to remove and recover remaining toner on the surface of the photoconductive substance 31Y with a blade to rub after transferring.

The image forming section 30M, the image forming section 30C, and the image forming section 30K have the same configuration as that of the image forming section 30Y except that the colors of toner are different and the laser light turns on and off in accordance with the image data corresponding to each color. Incidentally, in the figures, the components for different colors having the same configuration as that of the image forming section 30Y are denoted by the same numerals with different suffixes M, C, and K instead of Y.

The intermediate transfer belt 21 trains about a plurality of rollers and goes around in a direction 13 shown by an arrow in the figure during image forming. During go-around, the image (toner image) of each color is formed on the intermediate transfer belt 21 so as to be overlapped in an order of (Y), (M), (C) and (K) through the image forming sections 30Y, 30M, 30C and 30K whereby the color image is formed. The color image is transferred onto a transfer sheet from the intermediate transfer belt 21 at a secondary transfer position D near a roller 25.

At a downstream side, a pair of registration sensors 41*a* and 41*b* configured with reflection type optical sensors to detect a register mark on the intermediate transfer belt 21 is disposed. Two registration sensors 41*a* and 41*b* are disposed with a distance in a width direction of the intermediate transfer belt 21. Further, at a downstream side of the registration sensor 41*a* and 41*b*, a belt cleaning device 42 to remove the remaining toner on the intermediate transfer belt 21 after transferring is disposed.

The sheet feeding section 22 having a plurality of sheet feeding cassettes 22*a* to store the transfer sheet to be served for printing, serves a function to feed the transfer sheets one by one from a selected sheet feeding cassette 22*a* towards the conveyance section 23. Besides an ordinary passage 23*a* to pass the transfer sheet fed from the sheet feeding cassette 22*a* through the secondary transfer position D and the fixing device 24 and eject to the sheet ejection tray outside the apparatus. The sheet conveyance section 23 is provided with a reversal passage 23*b* to reverse an obverse side and reverse side of the transfer sheet having passed through the fixing device 24 and to merge the transfer sheet into the ordinary passage 23*a* at an upstream side of the secondary transfer position D after reversing to be capable of doublesided printing.

As FIG. 2 shows, the control section 14 is configured with a main body control section 14*a* and an image processing section 14*b*. The main body control section 14*a* serves a function to control the whole operation of the image forming apparatus 10 and is configured with a CPU (Central Processing Unit) 51, a ROM (Read Only Memory 52) and RAM (Random Access Memory) 53 as main components. The image processing section 14*b* serves a function where various kinds of image processing are applied to image data of each color outputted from the line color image sensor 16 of the readout section 12, and the image data is compressed to temporarily store, thereafter the image data of each color obtained by expanding the compressed image data is outputted to each of the image forming sections i.e. 30Y, 30M, 30C and 30M.

To the control section 14, the readout section 12, the display control section 13 and the printer section 20 are connected. The display control section 13 serves a function to receive various operations from the user and a function to display an operation screen, a setting screen and a guide screen for the user. The display control section 13 is configured with, for example, a liquid crystal display on whose surface a touch panel to detect pressed positions is provided and other switches.

The control section 14 controls operation of the printer section 20 via the CPU 51 of the printer section 20. To the CPU 51, a sensor and a drive section related to the sheet feeding section 22, the conveyance section 23 and the fixing device 24, besides the ROM 52 in which programs and various fixed data are stored and the RAM 53 to be a work area for the CPU 51 to execute programs.

The control section 14 conducts bias correction to correct a bias of the intermediate transfer belt 21 and color registration correction to detect and correct color shift of each color image to be overlapped on the intermediate transfer belt 21. Specifically, a belt drive motor 54 to drive the intermediate transfer belt 21, a bias sensor 55 to detect the bias of the intermediate transfer belt 21, a stepping motor 56 to drive a mechanism for correcting the bias of the intermediate transfer belt 21, and a pressure bonding/releasing section 57 to change a transfer roller (or a secondary transfer belt) which imposes a transfer sheet on the intermediate transfer belt 21 at the secondary transfer position D between a state of imposing on the intermediate transfer belt 21 and a state of dissociating by releasing imposing are connected to the CPU 51. The pressure bonding/releasing section 57 conducts imposing and releasing through a motor and a solenoid as power sources.

To the CPU 51, there are connected correction sections 58Y, 58M, 58C and 58K, disposed corresponding to each of image forming sections 30Y, 30M, 30C and 30K to conduct color shift correction by trimming an on/off timing of the laser light in accordance with the image data, and the registration sensors 41*a* and 41*b*.

First, bias correction control (hereinafter called steering control) of the intermediate transfer belt 21 will be described.

Figure 4:
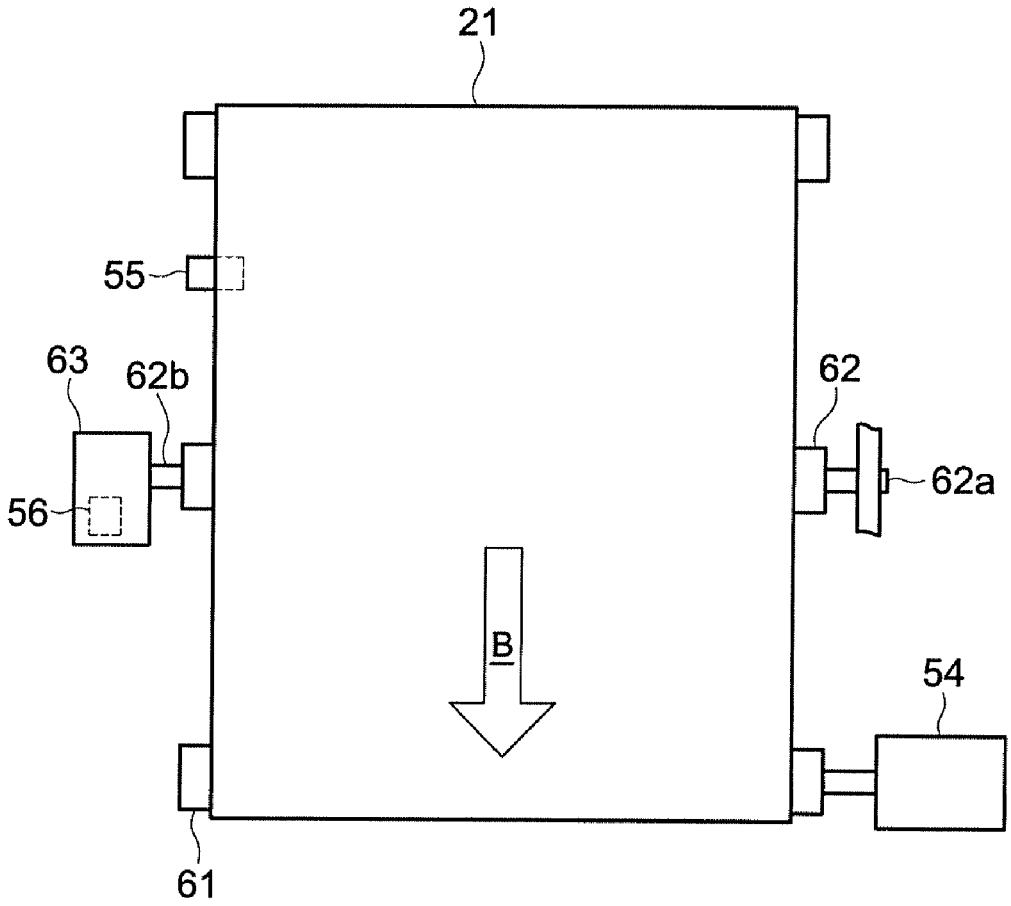
FIG. 4 is an explanatory drawing describing a driving mechanism of an intermediate transfer belt.
Figure 9:
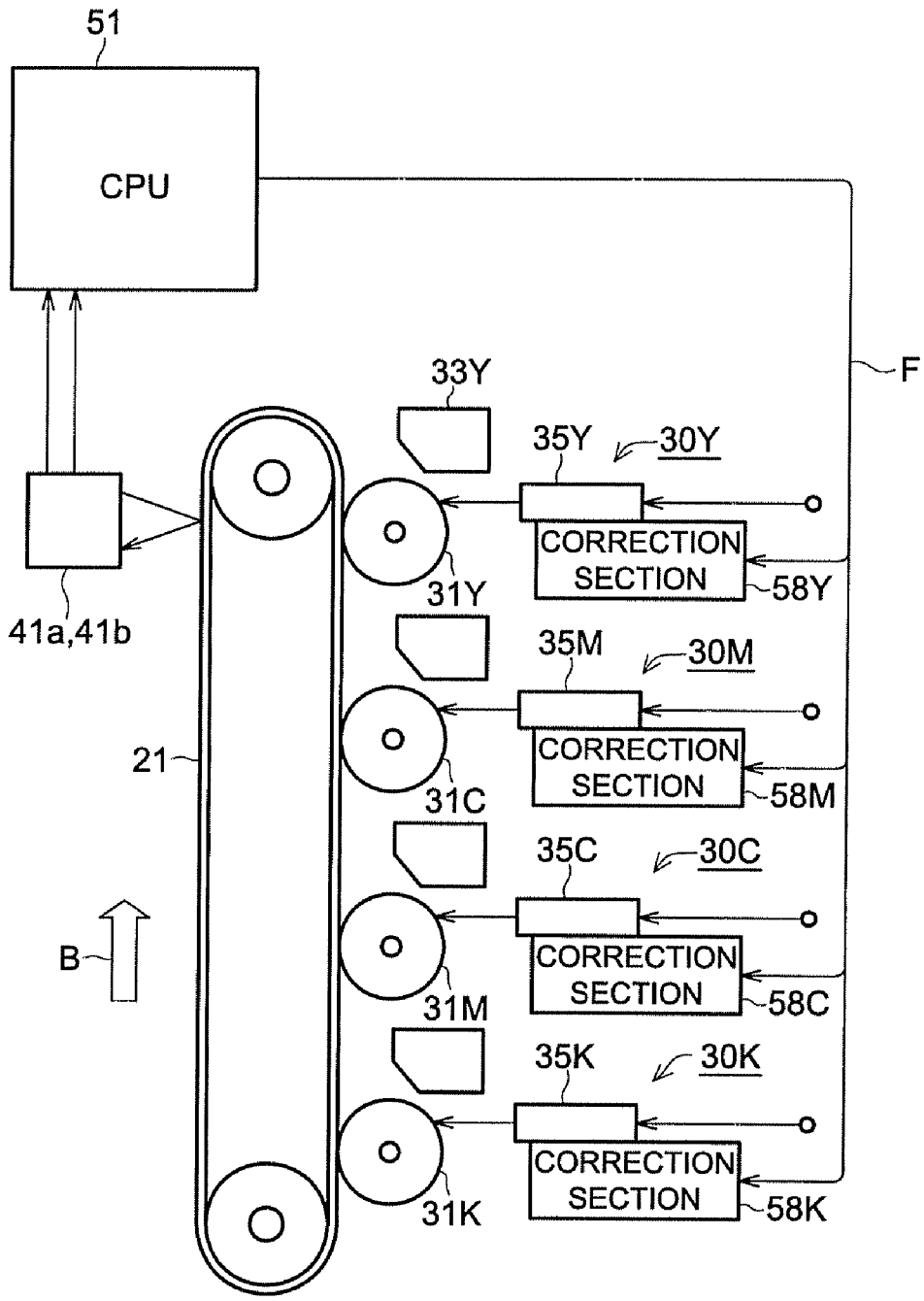
FIG. 9 is an explanatory drawing schematically indicating components related to color registration correction.

FIG. 4 schematically shows a drive mechanism of the intermediate transfer belt 21. The intermediate transfer belt 21 trains about a plurality of rollers in a shape of a cylinder to configure a circuit track (FIG. 1 and FIG. 9). Among rollers, a drive roller 61 is driven to be rotated by a belt drive motor 54 and other rollers are driven rollers not having power sources. An adjusting roller 62 is disposed in a way that an axis angle of the adjusting roller 62 is able to be changed centering around an end 62*a* of the adjusting roller 62, and the other end 62*b* of the adjusting roller 62 and supported by a movable bearing section 63 configured with gears and a stepping motor 56. By rotating the stepping motor 56 in forward and backward directions, the axis angle of the adjusting roller 62 can be adjusted in a predetermined angle range in plus direction and minus direction in respect to a parallel state to the axis of the drive roller 61.

Also, a bias sensor 55 to detect a position (a relative position with respect to a benchmark position) of the intermediate transfer belt 21 in a direction where a bias occurs (width direction of the intermediate transfer belt 21). As the bias sensor 55, for example, an optical sensor to detect a side edge of the intermediate transfer belt 21 is used.

Figure 5:
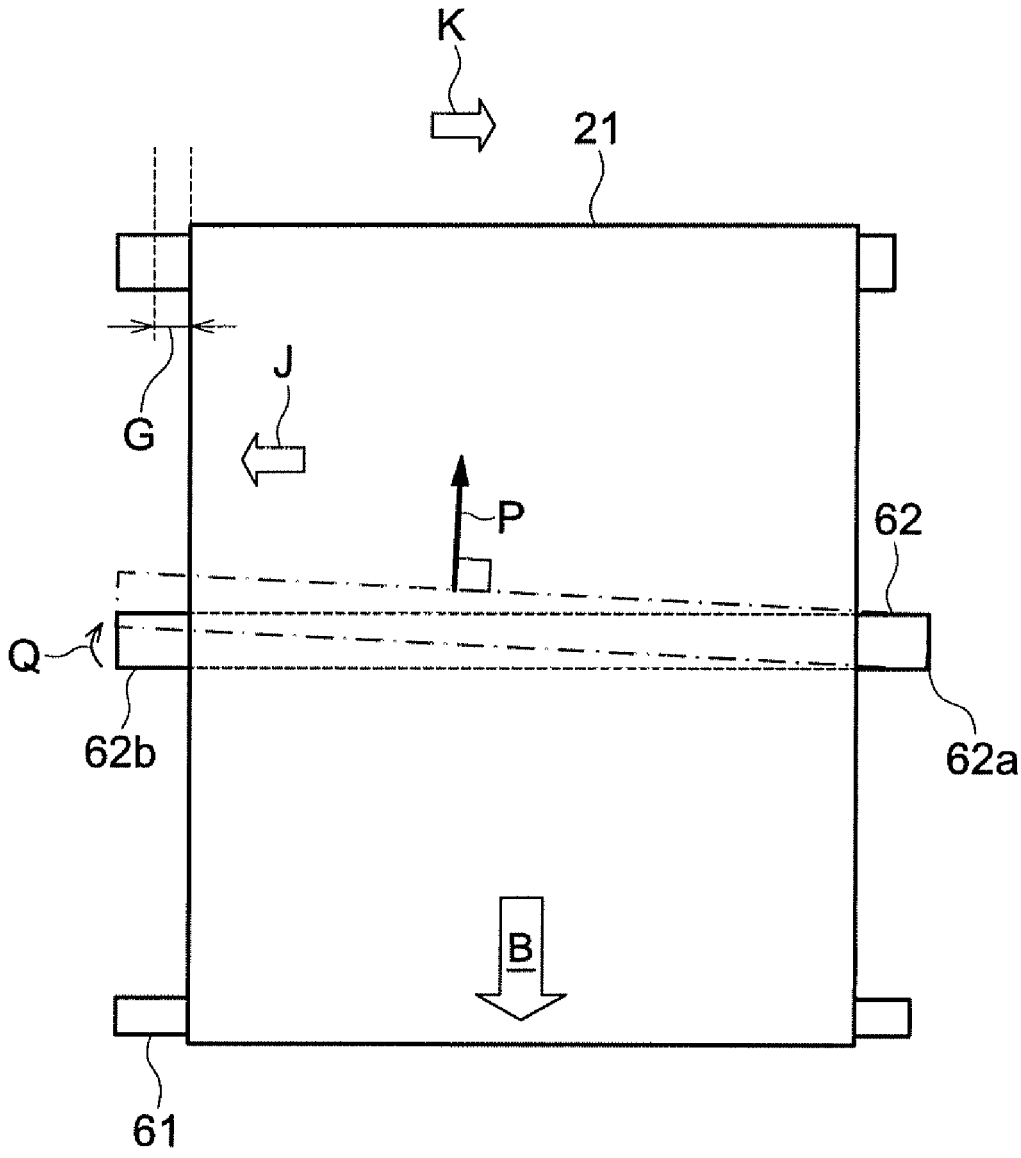
FIG. 5 is an explanatory drawing showing exemplary correction of bias correction.

FIG. 5 shows a specific example of the steering control to detect and correct the bias of the position of the intermediate transfer belt 21 in the width direction. In the steering control, the bias sensor 55 detects a bias amount G of the intermediate transfer belt 21 when the intermediate transfer belt 21 is biased in the width direction thereof, and the angle of the adjusting roller 62 is changed so that the intermediate transfer belt 21 moves in a direction to correct the bias. For example, in the example in FIG. 5, when the intermediate transfer belt 21 has shifted in a bias direction J, control is conducted in a way that the angle of the adjusting roller 62 is changed (correction amount Q in the figure) so that the intermediate transfer belt 21 moves in a belt moving direction K opposite to the bias direction J. As above, by adjusting the angle of the adjusting roller 62, a force is applied to the intermediate transfer belt 21 in a direction P in the figure so as to change the bias amount of the intermediate transfer belt 21. Steering control is conducted by the CPU 51. Also, steering control is always carried out during an image forming operation (during printing operation).

Next, color registration correction will be described.

Figure 6:
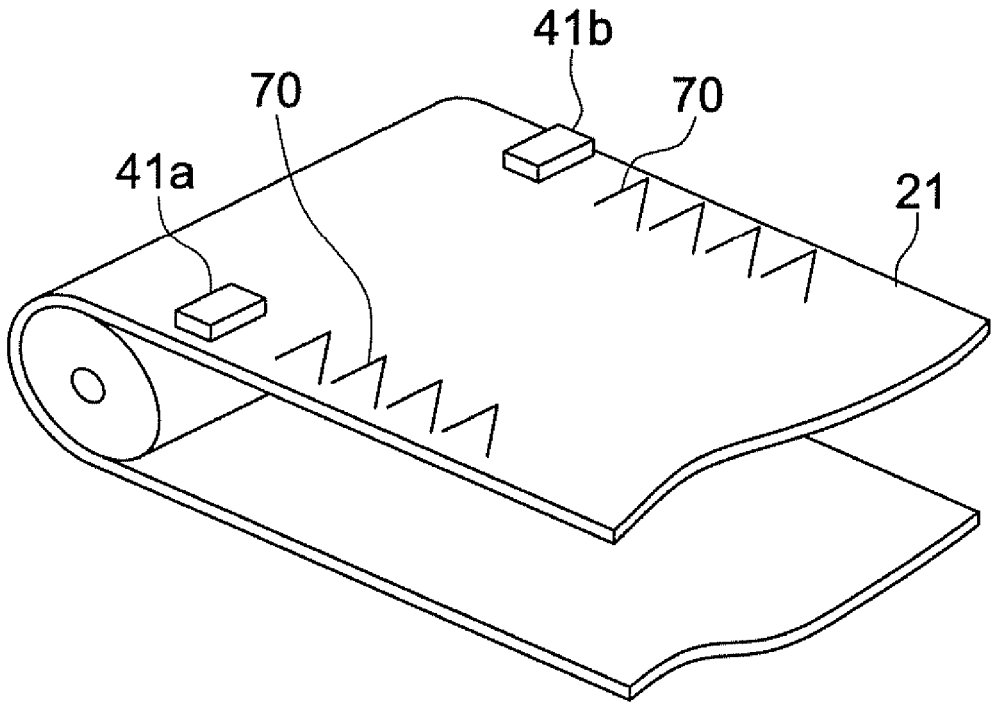
FIG. 6 is an explanatory drawing that exemplifies a state where registration marks are formed on an intermediate transfer belt.
Figure 7:
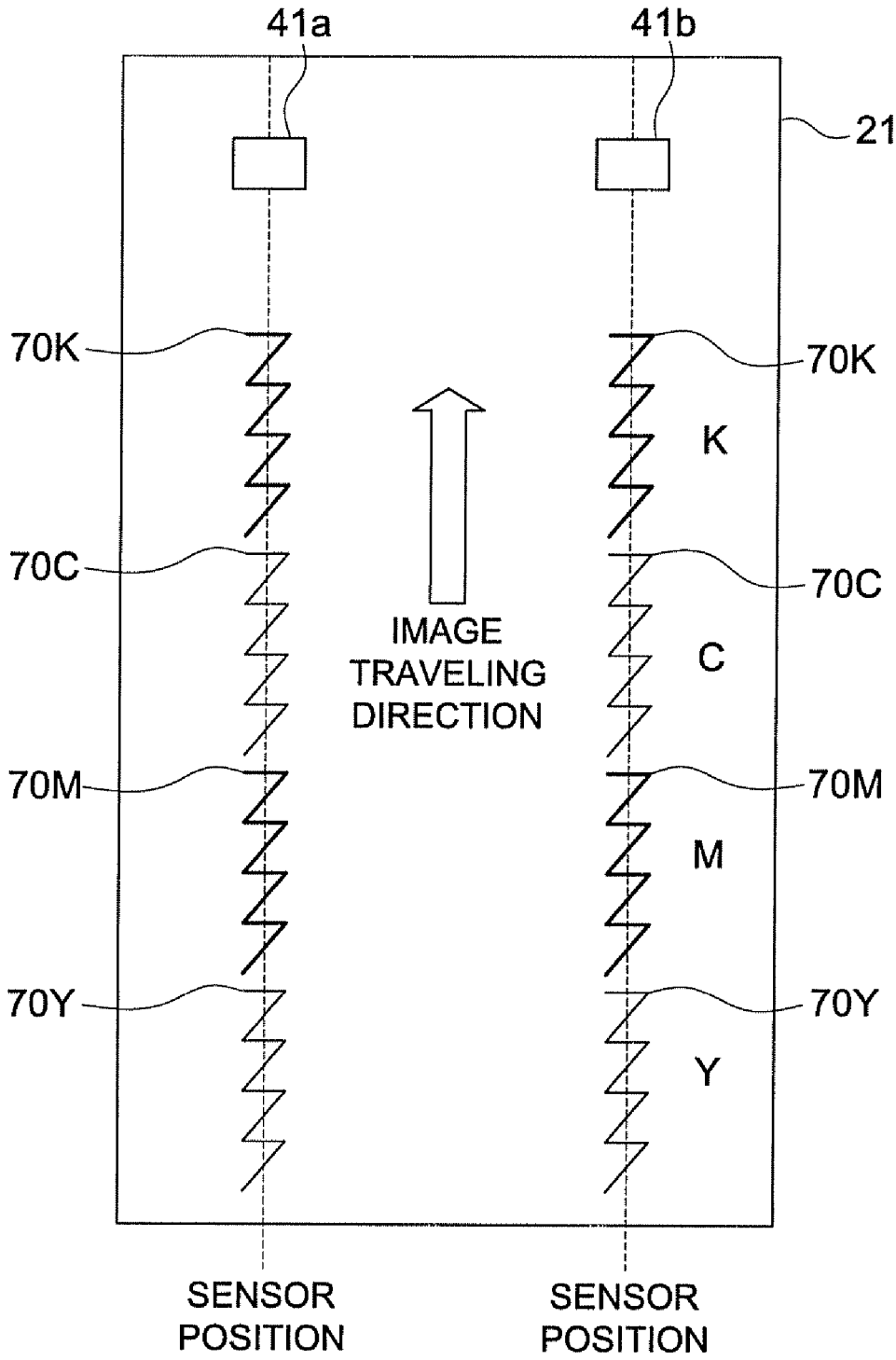
FIG. 7 is an explanatory drawing that exemplifies a state where registration marks of respective colors are formed on an intermediate transfer belt.

As FIG. 6 and FIG. 7 show, registration marks 70 (70Y, 70M, 70C and 70K) representing test images for color shift correction for respective colors are formed on the intermediate transfer belt 21 and the registration sensors 41*a* and 41*b* read the registration marks 70Y, 70M, 70C and 70K thereof to detect positional shift of the registration marks 70Y, 70M, 70C and 70K of respective colors. Then based on the detection results, correction of image forming positions is conducted so that color shift is eliminated.

Specifically, each of registration marks 70Y, 70M, 70C and 70K is a zigzag pattern where line images in the width direction of the intermediate transfer belt 21 and diagonal line images appear alternately and repeatedly (four times in the figure). The registration marks 70Y, 70M, 70*c* and 70K are formed at vicinities of both side edges in the width direction of the intermediate transfer belt 21, and read and detected through the registration sensors 41*a* and 41*b*.

Figure 8:
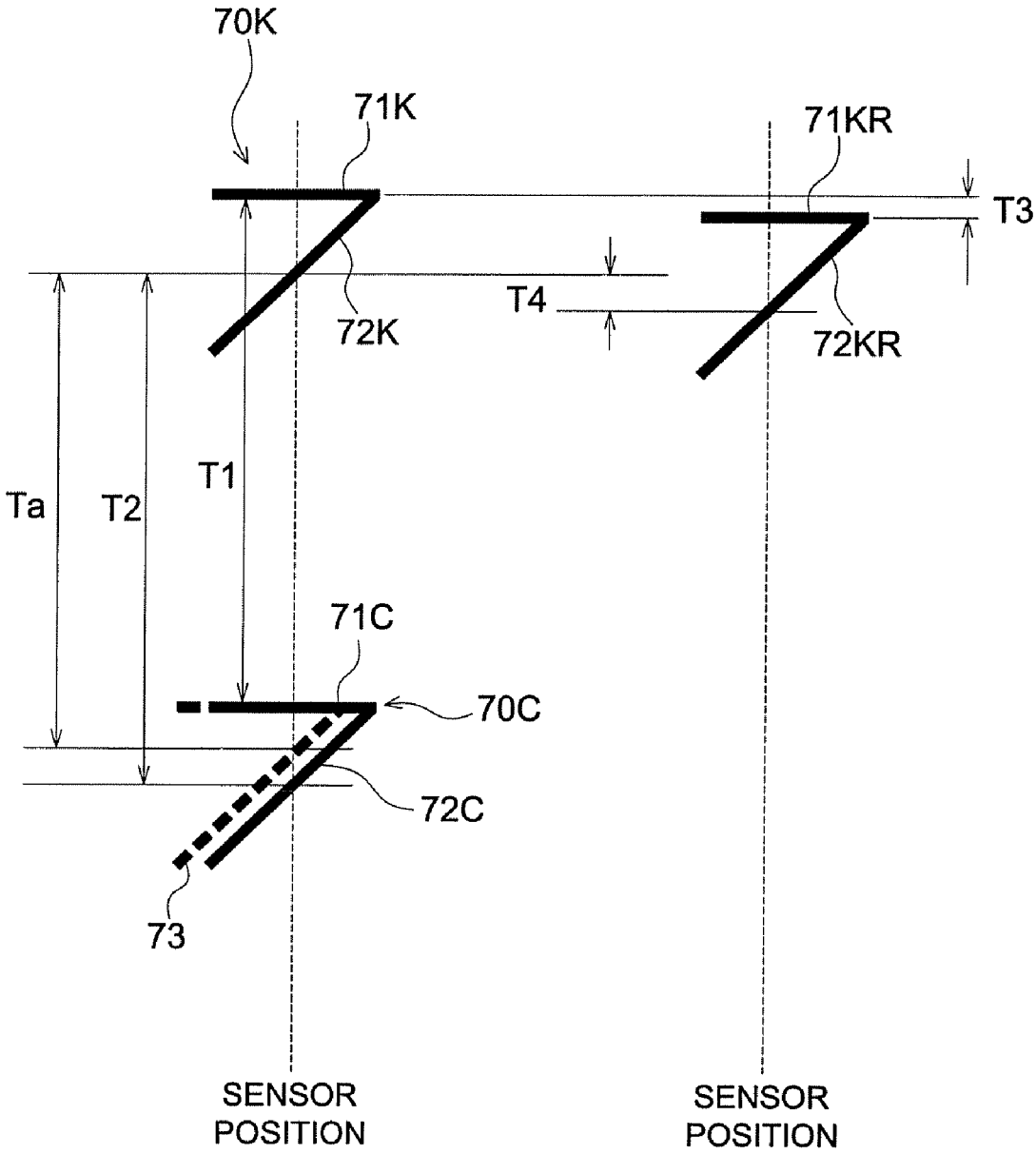
FIG. 8 is an explanatory drawing indicating a manner to judge positional shift of each color image from registration marks.

FIG. 8 shows a manner to detect positional shift of each color and a lateral magnification through the registration marks 70Y, 70M, 70C and 70K. For example, a positional relation between an image of K color and an image of C color in the sub-scanning direction (conveyance direction B of the intermediate transfer belt 21) can be recognized based on a time span Ti from detecting a width direction first line image of the registration mark 70K of K color to detecting a width direction first line image of registration mark 70C of C color.

Also, a positional relation between the image of the K color and the image of the C color in the main scanning direction (width direction of the intermediate transfer belt 21) can be recognized based on a relation between a time span T2 which is from detecting a diagonal first line image 72K of the registration mark 70K of the K color to detecting a diagonal first line image 72C of the registration mark of the C color, and the time spam Ti detected in the forgoing. For example, if T1=T2, the positional shift in the main scanning direction does not exist. As FIG. 8 shows, in case T2 is shorter than Ti (which is, for example Ta), it is recognized that an image 73 of the C color is shifted to the left in respect to the image of the K color, which broken lines in the figure shows. Also, the amount of positional shift can be recognized from a time difference between Tl and Ta. 71C represents a width direction first line image of the registration mark 70C Besides, a skew of the image of the K color is detected from a time difference (T3) between a detection time where the left registration sensor 41*a* detects the width direction first line image 71K of the registration mark 70K of the K color in a left array and a detection time where the right registration sensor 41*b* detects the width direction first line image 71KR in a right array. Also, a lateral magnification of the image of K color is detected based on a difference between former (T3) and a time difference (T4) which is between a detection time at which the left registration sensor 41*a* detects the diagonal first line image 72*k* of the registration mark 70K of the K color in the left array and a detection time at which the right registration sensor 41*b* detects the diagonal first line image 72KR in the right array. In the same manner, color shift, skews and magnifications of other colors are detected.

FIG. 9 schematically shows components related to color registration correction. The CPU 51 derives the amount of positional shift (color shift) with the aforesaid method, and informs each of correction sections 58Y, 58M, 58C and 58K of correction amounts F of image forming positions so that the positional shift is corrected (the amount of positional shift becomes zero). For example, in case a color image has color shift in the main scanning direction, each of the correction sections 58Y, 58M, 58C and 58K adjusts a time span from inputting a horizontal synchronous signal to indicate a timing at which a laser light crosses the benchmark position in the main scanning direction to starting on/off control of the laser light in accordance with the image data of each line.

As above, if the steering control is carried out while color registration correction is being carried out, the amount of color shift measured based on each of the registration marks 70Y, 70M, 70C and 70K becomes a sum of the color shift amount caused by positional shift of the image formed by each of the image forming sections 30Y, 30M, 30C and 30K and the color shift caused by shift of the intermediate transfer belt 21 due to steering control, thus if the color registration correction is carried out based on a measurement of the color shift amount, the correction amount may be inappropriate. Therefore, the control section 14 conducts bias correction (steering control) before carrying out color registration correction so as to stabilize the running state of the intermediate transfer belt 21, thereafter color registration correction is carried out while steering control is being ceased.

Figure 10:
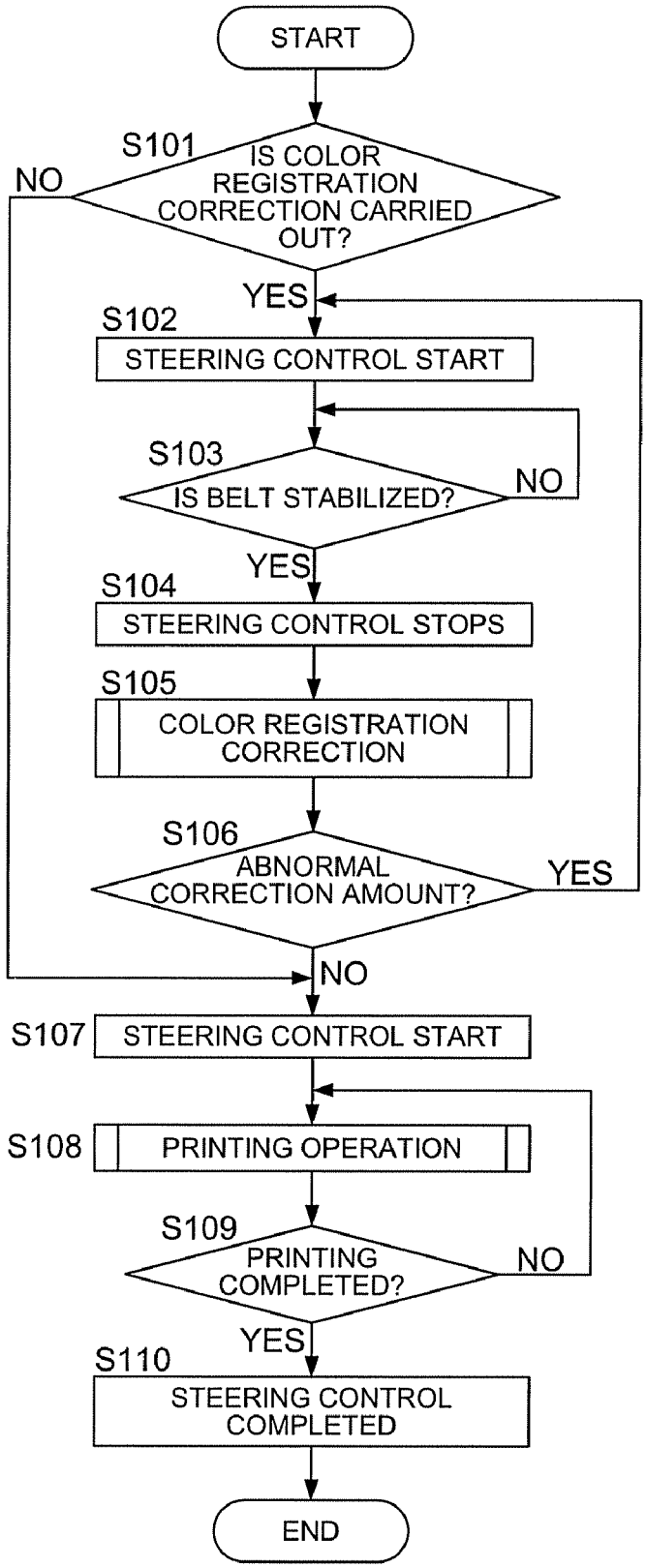
FIG. 10 is a flowchart showing operation of an image forming apparatus related to execution control of color registration correction and bias correction.

FIG. 10 show operation of the image forming apparatus 10 related to execution control of the color registration correction and the bias correction by the control section 14. First, whether or not an execution timing of the color registration correction is arrived is judged (Step S101). The color registration correction is executed every time when a number of prints reaches at a predetermined number, for example, 1000 pieces, necessity is judged based on temperature and humidity inside the apparatus or based on an execution instruction received from a user.

When the execution timing of color registration correction arrives (Step S101; Y), the steering control starts (Step S102) before execution of the color registration correction to stabilize the running condition of the intermediate transfer belt (Step S103).

In the above steps, the color registration correction can be carried out by eliminating effect of the bias correction completely. Since the control section stabilizes the intermediate transfer belt 21 before the color registration correction, even if the bias correction control is ceased during the color registration correction, the intermediate transfer belt 21 runs stably.

In this occasion, the steering control is continued for more than one cycle of the intermediate transfer belt 21 to confirm the stability. Also, whether or not the intermediate transfer belt 21 is stabilized is judged from a running condition in more than one cycle of the intermediate transfer belt 21. Whereby stability of the circulating intermediate transfer belt 21 is confirmed.

Also, the steering control before the color registration correction is carried out in a state where the running condition of the intermediate transfer belt 21 is the same as an execution condition of the color registration correction. Specifically, during a printing operation, at the secondary transfer position D, to impose the transfer sheet on the intermediate transfer belt 21, the transfer roller or the secondary transfer belt are imposed on the intermediate transfer belt 21. On the other hand, the color registration correction is carried out while imposing is released. A change of an imposing state affects the running state of the intermediate transfer belt 21. Therefore, to stabilize the running state of the intermediate transfer belt 21, steering control is carried out in a state where the pressure bonding/releasing section 57 is released by control and the running condition of the intermediate transfer belt 21 is accorded with the condition of the color registration correction.

In the forgoing, since the running condition of the intermediate transfer belt 21 is accorded with that of the color registration correction to carry out the bias correction, there is less possibility that the stable state of the intermediate transfer belt 21 obtained by the bias correction changes during execution of the color registration correction and the stable state can be maintained. For example, during printing operation, the transfer roller or the secondary transfer belt are imposed on the intermediate transfer belt 21 so as to transfer the toner image on the intermediate transfer belt 21 to the transfer sheet, and in case the imposing is released during the color registration correction, the bias correction before the color registration correction is carried out in a state where imposing is released.

The methods to stabilize the intermediate transfer belt 21 are as follows. Any one of the methods is selected in advance.

(1) To return the intermediate transfer belt 21 to a predetermined center position. The center position means a designed position where the intermediate transfer belt 21 becomes most stable. For example, it is a center position of a tolerance in the width direction of the intermediate transfer belt 21.

In the above method, the center position means a designed position at which the running state (bias state) of the intermediate transfer belt 21 is stable, thus by moving the intermediate transfer belt 21 to the center position, the intermediate transfer belt 21 is stabilized.

(2) To return the intermediate transfer belt 21 to a stable position detected in advance. A stable position of the intermediate transfer belt 21 where the running state (bias state) of the intermediate transfer belt 21 was most stable in the steering control carried out in the past is memorized, and the intermediate transfer belt 21 is moved to the stable position thereof. The stable position is preferred to be a position detected in a state where the running condition of the intermediate transfer belt 21 is accorded with the condition of the color registration correction.

In the above method, the intermediate transfer belt 21 can be stabilized by moving the intermediate transfer belt 21 to the stable position detected in an actual apparatus, the intermediate transfer belt 21 is stabilized without being affected by a difference between individuals.

(3) The running state is judged to be stable, in case, the change of the correction amount by steering control is not more than a permissible value (substantially zero), is maintained for a specific time period (for example, a time period of one cycle of the intermediate transfer belt 21), after execution of the steering control.

In the above method, the stability of the circulating intermediate transfer belt 21 can be obtained by executing the bias correction for more than one cycle of the intermediate transfer belt 21.

Meanwhile, the method in (3) can be carried out after the intermediate transfer belt 21 is moved to the position described in (1) or (2) when steering control starts.

After confirming the running state of the intermediate transfer belt 21 is stable (Step S103; Y), steering control is ceased (Step S104), thereafter the color registration correction is carried out (Step S105). Whereby the color registration correction is carried out in a state where the intermediate transfer belt 21 is stable without being affected by movement of the intermediate transfer belt 21 due to the steering control additionally.

In an abnormal case where the correction amount of the image forming position by the color registration correction exceeds a criterion value (Step S106; Y), there is a possibility that the intermediate transfer belt 21 has become unstable and moved during the color registration correction, returning to the Step S102, the process is repeated.

In case the correction amount is not abnormal (Step S106; N), the steering control starts (Step S107) and a printing operation is carried out while the steering control is in operation (Step S108), then when the requested printing operation is completed (Step S109; Y), steering control is ceased (Step S110) and the process is terminated (end).

As above, while the embodiment of the present invention has been described with reference to the drawings, practical configurations are not limited to the embodiment thereof, and it is to be understood that changes and variations may be made without departing from the spirit or scope of the appended claims.

The bias correction of the intermediate transfer belt 21 is not limited to the mechanism shown by FIG. 4, discretionary methods can be employed as far as the bias is corrected. Also, the shape of the registration marks for the color registration correction, the judging method and the correction method of the color shift amount are not limited to the one exemplified in the embodiment.

Also, before executing the color registration correction, whether or not the running state (bias state) of the intermediate transfer belt 21 is stable is confirmed. In case of a stable state, namely, the shifting amount of the intermediate transfer belt 21 in the width direction is maintained at substantially zero within a specific time period (for example, one cycle of the intermediate transfer belt 21), the color registration correction is carried out. In case of an unstable state, color registration correction can be carried out after the intermediate transfer belt 21 is stabilized by the steering control.

In the forgoing, in case the intermediate transfer belt 21 is stable from the beginning, the control section does not conduct the bias correction, thus an elapsing time until the color registration correction is completed can be shortened by that much.

Also in the forgoing, stable running of the entire intermediate transfer belt 21 in circulation is confirmed.

In the embodiment, the steering control is ceased during execution of the color registration correction, however after confirming the stable running state of the intermediate transfer belt 21, the color registration correction can be executed with the steering control being continued.

According to the image forming apparatus related to the present invention, the color registration correction can be carried out without the amount of color shift caused by shift of the intermediate transfer belt 21 being included.

What is claimed is:

1. An image forming apparatus to form a color image, comprising:

a plurality of image forming sections to form images of respective colors;

an intermediate transfer belt on which the images of the respective colors are formed and overlapped by transferring through the plurality of the image forming sections so as to form a color image; and a control section to conduct color registration correction for correcting image forming positions of the images of the respective colors that are formed through the plurality of the image forming sections on the intermediate transfer belt and to conduct bias correction of the intermediate transfer belt for correcting a bias of the intermediate transfer belt;

wherein the color registration correction is carried out after a running state of the intermediate transfer belt is stabilized through the bias correction of the intermediate transfer belt.

2. The image forming apparatus of claim 1, wherein the control section confirms whether or not the running state of the intermediate transfer belt is stable before the color registration correction, and conducts the color registration correction if the running state of the intermediate transfer belt is stable, or conducts the bias correction to stabilize the running state of the intermediate transfer belt if the running state of the intermediate transfer belt is not stable, then conducts the color registration correction.

3. The image forming apparatus of claim 2, wherein the control section judges whether or not the intermediate transfer belt runs stably from the running state in a time period of not less than one cycle of the intermediate transfer belt.

4. The image forming apparatus of claim 1, wherein the control section conducts the bias correction before the color registration correction in a way that the intermediate transfer belt is returned to a center position.

5. The image forming apparatus of claim 1, wherein the control section conducts the bias correction before the color registration correction in a way that the intermediate transfer belt is returned to a center position after detecting a stable position of the intermediate transfer belt.

6. The image forming apparatus of claim 1, wherein the control section conducts the bias correction before the color registration correction in a way that a running condition of the intermediate transfer belt is accorded with a condition of the color registration correction.

7. The image forming apparatus of claim 1, wherein the control section does not conduct the bias correction during the color registration correction.

8. The image forming apparatus of claim 1, wherein the control section conducts the bias correction before the color registration correction to be continued for a time period of not less than one cycle of the intermediate transfer belt.

9. The image forming apparatus of claim 1, wherein the control section forms test images for correcting positional shift of the images of respective colors formed through the plurality of image forming sections on the intermediate transfer belt, and measures positional relations of the test images on the intermediate transfer belt so as to conduct the color registration correction in accordance with measurement results thereof, and detects a bias of the intermediate transfer belt so as to conduct the bias correction.

* * * * *